US010121464B2

(12) United States Patent
Lee et al.

(10) Patent No.: US 10,121,464 B2
(45) Date of Patent: Nov. 6, 2018

(54) SUBBAND ALGORITHM WITH THRESHOLD FOR ROBUST BROADBAND ACTIVE NOISE CONTROL SYSTEM

(71) Applicants: Ford Global Technologies, LLC, Dearborn, MI (US); University of Cincinnati, Cincinnati, OH (US)

(72) Inventors: Ming-Ran Lee, Troy, MI (US); Takeshi Abe, Garden City, MI (US); Ming-te Cheng, Ann Arbor, MI (US); Frederick Wayne Vanhaaften, Northville, MI (US); Liqun Na, Northville, MI (US); Teik Lim, Mason, OH (US); Mingfeng Li, Cincinnati, OH (US); Guohua Sun, Cincinnati, OH (US); Tao Feng, Cincinnati, OH (US)

(73) Assignees: Ford Global Technologies, LLC, Dearborn, MI (US); University of Cincinnati, Cincinnati, OH (US)

( * ) Notice: Subject to any disclaimer, the term of this patent is extended or adjusted under 35 U.S.C. 154(b) by 0 days.

(21) Appl. No.: 14/563,109

(22) Filed: Dec. 8, 2014

(65) Prior Publication Data

US 2016/0163304 A1 Jun. 9, 2016

(51) Int. Cl.
*G10K 11/16* (2006.01)
*G10K 11/178* (2006.01)

(52) U.S. Cl.
CPC .... *G10K 11/1781* (2018.01); *G10K 11/17854* (2018.01); *G10K 11/17879* (2018.01);
(Continued)

(58) Field of Classification Search
CPC ..... H04R 3/002
(Continued)

(56) References Cited

U.S. PATENT DOCUMENTS 5,561,598 A * 10/1996 Nowak ..... G05B 13/024 381/71.11
6,744,886 B1 6/2004 Benesty et al.
(Continued)

FOREIGN PATENT DOCUMENTS

CN 104035332 * 9/2014

OTHER PUBLICATIONS

Numerical modeling and active noise control of impact road noise inside a vehicle compartment,Duan et al., researchgate, 2015, based on a paper presented 2012 at Internoise (https://www.researchgate.net/profile/Guohua_Sun/publication/272947321_Numerical_modeling_and_active_noise_control_of_impact_road_noise_inside_a_vehicle_compartment/links/55ef77.*
(Continued)

*Primary Examiner* — William Deane, Jr.
(74) *Attorney, Agent, or Firm* — Frank MacKenzie; Brooks Kushman P.C.

(57) ABSTRACT

An active noise control (ANC) system includes a speaker and one or more processors. The one or more processors implement an adaptive subband filtered reference control algorithm that applies thresholds to reference and error feedback signal paths such that, in response to a series of broadband non-Gaussian impulsive reference signals indicative of road noise in the vehicle having an audible frequency range of 20 Hz to 20 kHz, weight coefficients defining an adaptive filter of the control algorithm converge and permit the ANC system to partially cancel the road noise via output of the speaker.

20 Claims, 6 Drawing Sheets

(52) U.S. Cl.
CPC ..... *G10K 2210/12821* (2013.01); *G10K 2210/3028* (2013.01); *G10K 2210/3218* (2013.01)

(58) Field of Classification Search
USPC ..... 381/71.4, 71.12, 71.11
See application file for complete search history.

(56) References Cited

U.S. PATENT DOCUMENTS

| | | | | |
|---|---|---|---|---|
| 8,199,923 | B2 * | 6/2012 | Christoph | G10K 11/1784 381/71.1 |
| 8,335,318 | B2 * | 12/2012 | Pan | G10K 11/1782 381/56 |
| 8,509,465 | B2 | 8/2013 | Theverapperuma | |
| 8,553,898 | B2 | 10/2013 | Raftery | |
| 8,687,819 | B2 * | 4/2014 | Kunzle; Bernhard | G10L 21/0208 381/71.11 |
| 9,099,077 | B2 * | 8/2015 | Nicholson | G10K 11/1782 |
| 9,131,915 | B2 * | 9/2015 | Amiri Farahani | A61B 6/5258 |
| 9,478,212 | B1 * | 10/2016 | Sorensen | H03G 5/165 |
| 2005/0207585 | A1 * | 9/2005 | Christoph | G10K 11/1788 381/71.11 |
| 2006/0069556 | A1 * | 3/2006 | Nadjar | G10K 11/178 704/229 |
| 2010/0284546 | A1 * | 11/2010 | DeBrunner | G10K 11/178 381/71.2 |
| 2012/0170766 | A1 * | 7/2012 | Alves | G10K 11/1784 381/71.11 |
| 2013/0259253 | A1 * | 10/2013 | Alves | G10K 11/1784 381/71.12 |
| 2013/0343557 | A1 * | 12/2013 | Sontacchi | H04R 3/002 381/71.6 |
| 2014/0198925 | A1 * | 7/2014 | Alves | G10K 11/1784 381/71.6 |

OTHER PUBLICATIONS

M-estimation impulsive noise active control method—translation—CN 104035332, Sep. 10, 2014.*

Li, Peng, et al., Active Noise Cancellation Algorithms for Impulsive Noise, Mech. Syst. Signal Process, doi:10.1016/i.ymssp. 2012.10. 017, vol. 36, No. 2, Apr. 1, 2013, 9 pages.

Kuo, Sen M., et al., Active Noise Control Systems, Algorithms and DSP Implementations, Wiley Series in Telecommunications and Signal Processing, 1996, 408 pages.

Dehandschutter, W., et al., Active Control of Structure-Borne Road Noise Using Vibration Actuators, Journal of Vibration and Acoustics, vol. 120, Apr. 1998, 7 pages.

Duan, Jie, Active Control of Vehicle Powertrain Noise Applying Frequency Domain Filtered-x LMS Algorithm, University of Cincinnati, PhD Thesis for the degree of Mechanical Engineering, May 7, 2009, 55 pages.

Duan, Jie, Active Control of Vehicle Powertrain and Road Noise, a dissertation submitted to the Graduate School of the University of Cincinnati in partial fulfillment of the requirements for the degree of Doctor of Philosophy, Jun. 1, 2011, 212 pages.

Elliott, S.J., et al., The Active Control of Low Frequency Engine and Road Noise Inside Automotive Interiors, Active Noise and Vibration Control Journal, Annual Meeting of American Society of Mechanical Engineers, vol. 8, Nov. 1990, 6 pages.

Elliott, S.J., A Review of Active Noise and Vibration Control in Road Vehicles, Institute of Sound and Vibration Research, ISVR Technical Memorandum No. 981, Dec. 2008, 25 pages.

Morgan, Dennis R., et al., A Delayless Subband Adaptive Filter Architecture, IEEE Transactions on Signal Processing, vol. 43, No. 8, Aug. 1995, 12 pages.

Park, Seon Joon, et al., A Delayless Subband Active Noise Control System for Wideband Noise Control, IEEE Transactions on Speech and Audio Processing, vol. 9, No. 8, Nov. 2001, 8 pages.

Sano, Hisashi, et al., Active Control System for Low-Frequency Road Noise Combined with an Audio System, IEEE Transactions on Speech and Audio Processing, vol. 9, No. 7, Oct. 2001, 9 pages.

Sutton, Trevor J., et al., Active Control of Road Noise Inside Vehicles, Institute of Noise Control Engineering Journal 42, No. 4, Jul. 1994, 11 pages.

Guohua Sun, et al., Modified Filtered-x Algorithm for Active Control of Vehicle Road Impact Noise, Inter.Noise, New York, New York, Aug. 19-22, 2012, 12 pgs.

* cited by examiner

SUBBAND ALGORITHM WITH THRESHOLD FOR ROBUST BROADBAND ACTIVE NOISE CONTROL SYSTEM

TECHNICAL FIELD

This application relates to vehicle active noise control systems.

BACKGROUND

There are several noise sources inside a vehicle cabin, such as powertrain, tire-road, wind and various electrical components. The powertrain noise is typically dominant when the engine is in idle or changing speeds. On the other hand, the dominant vehicle interior noise is structure-borne road noise when driving at speeds over 30-40 km/h. These noises are the primary disturbance that may annoy passengers and influence the perceived quality of the vehicle performance. As such, certain automotive manufactures are improving vehicle noise, vibration and harshness (NVH) performance to fulfill customer requirements.

SUMMARY

In one example, an enhanced subband filtered-x least mean M-estimator (FXLMM) algorithm with thresholds on reference and error signal paths is proposed as the basis for an active noise control (ANC) system to treat road noise with impacts. This algorithm may overcome inherent limitations of the standard filtered-x least mean squares (FXLMS) algorithm for colored noise control such as high computational cost and low convergence speed. Furthermore, instability issues of the FXLMS algorithm for non-Gaussian impact road noise due to road bumps or potholes may be avoided.

In another example, a vehicle includes an active noise control (ANC) system. The ANC system includes a processor to implement an adaptive subband filtered reference control algorithm that applies thresholds to reference and error feedback signal paths such that, in response to a series of broadband non-Gaussian impulsive reference signals indicative of road noise in the vehicle, weight coefficients defining an adaptive filter of the control algorithm converge and permit the ANC system to partially cancel the road noise. Values of the thresholds may be based on a variance of magnitudes of the impulsive reference signals. The values may increase as the variance increases. Values of the thresholds may be based on percentile characteristics of the impulsive reference signals. The adaptive subband filtered reference control algorithm may be delayless. The adaptive subband filtered reference control algorithm may be a filtered-x least mean square (FXLMS) adaptive subband filtered reference control algorithm or a filtered-x least mean M-estimator (FXLMM) adaptive subband filtered reference control algorithm. The adaptive subband filtered reference control algorithm may include a discrete Fourier transform (DFT) filter bank. Other examples are also described herein.

DETAILED DESCRIPTION

Figure 1:
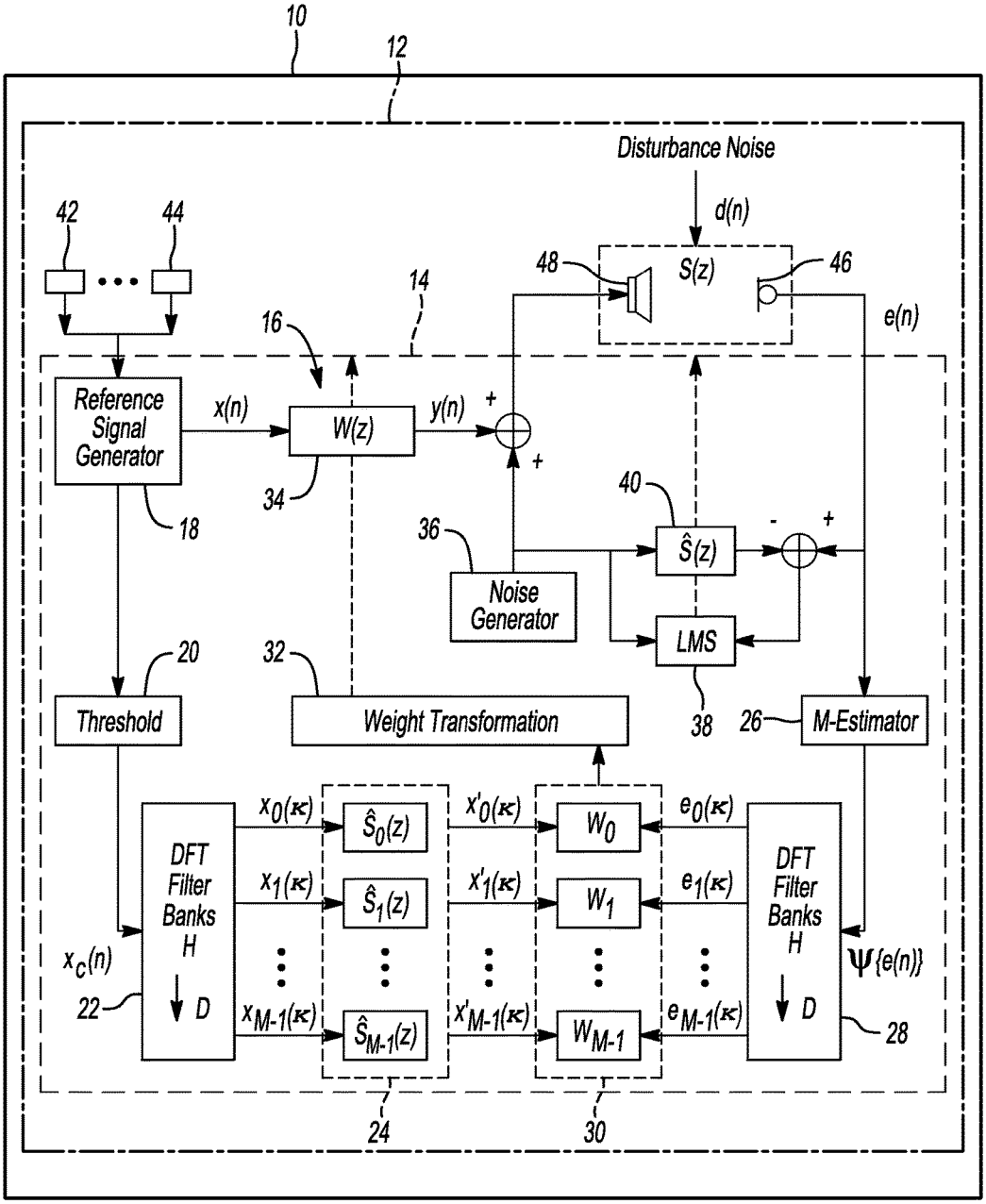
FIG. 1 is a feed-forward control diagram configured with a modified subband FXLMS algorithm with thresholds within the context of an active noise control system for a vehicle.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

INTRODUCTION

To achieve a better NVH performance within the passenger compartment, the common refining approach is typically implemented by adding more mass, tuning stiffness and damping properties of certain components, and designing various types of mufflers. However, this technique is restricted by low frequency limitations. Alternatively, active noise control (ANC) technology has demonstrated a promising way to tune the lower-frequency powertrain and road noises inside a vehicle cabin.

There are numerous research efforts driven to develop a feasible ANC system for automotive applications, which mostly deal with stationary noises such as powertrain-related noise and normal road noise. More precisely, stationary noise is different from the highly transient phenomenon that tends to generate non-Gaussian type noises such as vehicle impact road noise. Structure-borne road noise is a colored broadband noise with most energy lying in the low frequency range from 60 to 400 Hz. Hence, it may be effective to design a feedforward ANC system to control road noise by using accelerometers to pick up the reference signals in the dominant structure-borne paths. For instance, some have proposed a multi-channel ANC system configured with the conventional filtered-x least mean square (FXLMS) algorithm for low frequency engine and road noise. Others have developed an active structural acoustic control (ASAC) system for structure-borne road noise by using an inertia shaker as the control actuator, attached in parallel with the suspension system, to modify the vibration behavior of the vehicle floor panel such that the radiated noise is decreased. More recently, an ANC system for road noise control has been combined with a vehicle built-in audio system and feedback system without requiring additional reference accelerometers. Most of these types of systems use an adaptive FXLMS algorithm. The conventional FXLMS algorithm, however, has inherent inefficiencies (e.g., high computational burden and slow convergence speed) when directly applied to road noise control. This is because broadband road noise normally requires a longer order adaptive filter, and the specified step size of the FXLMS algorithm is not optimal for all frequencies due to large eigenvalue spread of the colored reference signal.

The subband-based FXLMS algorithm is one alternative to overcome the inherent limitations of the conventional FXLMS algorithm, especially when the adaptive filter requires hundreds of filter taps for broadband noise. The idea of subband adaptive filtering is to decompose the fullband input reference and error signals into a certain number of subbands and down-sample the subband signals from a higher sampling rate to a lower one—reducing the number of adaptive filter weights required for each band. Furthermore, the subband filtering process will equalize the spectrum of the reference signal in each band, which gives less spectra dynamic range, thereby significantly improving the convergence speed. These early subband structures, however, tend to incorporate an additional delay in the signal path due to the implementation of two analysis filters for decomposing the signals into subbands and one synthesis filter for combining the subband signals into the full band. In ANC applications for broadband noise, this delay may significantly deteriorate the convergence performance and even cause instability due to the violation of non-causality. Hence, some have proposed a delayless subband adaptive filter in which the synthesis filter of a conventional subband algorithm was removed, and the filter weights in each band combined and transformed into the time-domain for update in each sample point. The frequency-domain implementation of the delayless subband ANC algorithm has also been proposed. Others, for example, have developed a combined feedforward and feedback ANC system using the subband processing technique for vehicle interior road noise. The subband algorithm has balanced convergence ability over the broadband frequency range and yields overall reductions close to the theoretical value.

In spite of several promising successes reported in the open literature, one of the major concerns for ANC of (random in nature) road noise is the unsteady process for the reference accelerometers and perceived road noise that are easily affected by the road unevenness. In contrast, the ANC system for powertrain noise is more deterministic and tachometer signal monitoring of the engine speed is normally used as a reference. Confounding conditions for ANC of road noise includes impact acoustic responses due to road surface unevenness or discontinuities such as road bumps and potholes. These types of impulsive noises normally follow non-Gaussian statistical distributions. Hence, the conventional FXLMS algorithm, proposed based on the assumption of deterministic and/or Gaussian signals, tends to pose a stability issue for ANC systems. To address the inherent slow convergence of the FXLMS algorithm for colored noise and its instability issue for the non-Gaussian impact noise, more advanced control systems are proposed.

Here, robust ANC systems for broadband road noise with impacts are disclosed. An enhanced delayless subband algorithm, for example, embeds the advantages of a set of M-estimator based algorithms to deal with impulsive broadband disturbances. The M-estimators are more robust for impulsive samples compared to the standard $L_2$-indicator used by the FXLMS algorithm. In addition, a threshold in the reference signal path may be incorporated to further improve the robustness of the algorithm. To validate the effectiveness of the proposed system, numerical simulation was conducted to control actual impact road noise.

A detailed derivation of the general subband-based modified FXLMM algorithm is introduced first in which the filter weight update equation is given in a general form to quantify the robustness of various M-estimator error functions for impulsive samples. In addition, a threshold bound is introduced in the reference signal path to further enhance the robustness of the adaptive filter weight update process such that disturbances from peaky data are avoided. Both online and offline approaches are applied to determine relevant threshold parameters included in each robust M-estimator function. Hence, fast convergence can be obtained and optimal performance achieved over the broader frequency range for impact colored noise control. To validate the performance of the proposed system, numerical simulations were conducted for controlling measured road noises with impacts.

Controller with Enhanced Subband Algorithm

Robust M-Estimator Algorithm

FIG. 1 shows a diagram of a vehicle 10 including an active noise control (ANC) system 12. The ANC system 12, in this example, includes at least one processor 14 implementing a feedforward control 16 configured with a modified subband FXLMM algorithm with thresholds. The feedforward control 16, in this example, includes a reference signal generator block 18, a threshold block 20, Discrete Fourier Transform (DFT) filter banks 22, and subband secondary path blocks 24. The feedforward control 16 further includes an M-estimator block 26, DFT filter banks 28, and filter weights update blocks 30. The feedforward control 16 further includes weight transformation block 32, adaptive filter block 34, noise generator block 36, least mean squares algorithm block 38, and estimated secondary path block 40. Here, x(n) is the reference signal that can be picked up by a set of accelerometers and/or microphones 42 to 44, d(n) is the primary noise picked up by microphone 46, and e(n) is the error signal after superposition of the primary noise and secondary canceling noise. The secondary canceling noise is output to a cabin of the vehicle 10 via speaker 48. This arrangement can of course be extended to a multichannel configuration.

The standard fullband FXLMS algorithm uses the reference signal x(n) to generate the secondary noise adaptively, which is monitored by the error signal e(n). However, it requires an accurate model of the secondary transfer path $\hat{S}$ from the control speaker to the error microphone, which can be estimated by using offline or online system identification approaches. The filter weight update equations of the FXLMS algorithm can be summarized as $$y(n)=w(n)^T x(n) \tag{1a}$$

$$e(n)=d(n)y'(n) \tag{1b}$$

$$w(n+1)=w(n)+\mu e(n)[\hat{S}(n)*x(n)] \tag{1c}$$

where μ is the convergence step size, and the step size needs to be tuned in the filter weights update blocks 30 shown in FIG. 1. The step size determines the convergence and stability of the FXLMS algorithm, and $\hat{S}$ is the impulse response of the secondary path S(z). From Eqn. (1c), one can see that the filter weight update equation may burst into a large value and diverge when there are peaky impulses occurring in the reference and/or error signal. This makes the typical FXLMS algorithm unstable for impulsive noise. To improve the robustness of the conventional FXLMS algorithm for impulsive samples, several approaches have been adopted by previous researchers, either based on formulating more robust error criteria or relying on simple modification of the FXLMS algorithm by adding thresholds in the reference and/or error signal path. Here, a general family of enhanced M-estimator based algorithms is developed, which unifies all existing adaptive algorithms for impulsive noise control.

The M-estimator is a popular approach in robust statistics to remove the adverse effect of outliers in the estimation process. The common least square algorithm, which is designed to minimize the cost function of $\Sigma_n e^2(n)$, may become unstable if the data is corrupted with outliers. Hence, the robust M-estimator function $\Sigma_n \rho\{e(n)\}$ has been used to replace the least square method. Here, the function $\rho\{e(n)\}$ is considered as a general robust formulation that yields a stable estimator for outliers in the processed data.

$$J(n)=E[\rho\{e(n)\}]\approx\rho\{e(n)\} \tag{2}$$

where $\rho\{e(n)\}$ is the family of M-estimator functions. The first derivative of the objective cost function is $$\hat{\nabla}(n)=\frac{\partial J(n)}{\partial w(n)}=\frac{\partial \rho\{e(n)\}}{\partial w(n)}=\frac{\partial \rho\{e(n)\}}{\partial e(n)}\frac{\partial e(n)}{\partial w(n)}=-\psi\{e(n)\}[\hat{S}(n)*x(n)] \tag{3}$$

where $$\psi\{e(n)\}\frac{\partial \rho\{e(n)\}}{\partial e(n)}$$

is the score function, which controls the influence of the error signal by impulsive samples. Then applying the steepest decent algorithm, the filter weight update equation of the family of M-estimator based algorithms is expressed as $$w(n+1)=w(n)+u\psi\{e(n)\}[\hat{S}(n)*x(n)] \tag{4}$$

The impulses, however, in the reference signal may still have adverse influence on the filter weight update process for these M-estimator based algorithms. Although some of the scoring functions $\psi\{e(n)\}$ can restrict the impulsive samples in the error signal and guarantee that the whole term $\psi\{e(n)\}[\hat{S}(n)*x(n)]$ does not diverge too much at a certain time index, it still has stability problems since there is typically certain time delay between the reference signal and error signal. The impulsive samples in the reference signal can result in the burst of the term $\psi\{e(n)\}[\hat{S}(n)*x(n)]$. Therefore, a family of enhanced M-estimator based algorithms is proposed to further increase the robustness in the presence of impulses.

The filter weight update of the modified algorithm is $$w(n+1)=w(n)+u\psi\{e(n)\}[\hat{S}(n)*x_c(n)] \tag{5a}$$

$$x_c(n)=\begin{cases} c_2 & x(n)\geq c_2 \\ c_1 & x(n)\leq c_1 \\ x(n) & \text{otherwise}\end{cases} \tag{5b}$$

The threshold parameters $c_1$ and $c_2$ can be estimated by offline-calculated statistics (such as by choosing the $1^{th}$ and $99^{th}$ percentile of the original signal).

Table 1 describes the adaptive filter weight update equations of the proposed family of M-estimator based algorithms. Here, different score functions are included in each algorithm to enhance the robustness of the error signal for impulsive samples.

TABLE 1

| M-estimator | | Filter weight update equation |
|---|---|---|
| Robust space | $L_p$ | $w(n+1)=w(n)+u\psi_{L_p}\{e(n)\}[\hat{S}(n)*x_c(n)]$ |
| | | $\psi_{L_p}\{e(n)\}=\lvert e(n)\rvert^{p-1}\,\mathrm{sign}[e(n)]$ |
| | Log | $w(n+1)=w(n)+u\psi_{Log}\{e(n)\}[\hat{S}(n)*x_c(n)]$ |
| | | $\psi_{Log}\{e(n)\}=\frac{\log\lvert e(n)\rvert}{\lvert e(n)\rvert}\mathrm{sign}[e(n)]$ |
| Huber | | $w(n+1)=w(n)+u\psi_H\{e(n)\}[\hat{S}(n)*x_c(n)]$ |
| | | $\psi_H\{e(n)\}=\begin{cases} e(n) & 0\leq\lvert e(n)\rvert\leq k \\ k\,\mathrm{sign}[e(n)] & \lvert e(n)\rvert>k\end{cases}$ |
| Fair | | $w(n+1)=w(n)+u\psi_F\{e(n)\}[\hat{S}(n)*x_c(n)]$ |
| | | $\psi_F\{e(n)\}=\frac{e(n)}{1+\lvert e(n)\rvert/c}$ |
| Hampel | | $w(n+1)=w(n)+u\psi_M\{e(n)\}[\hat{S}(n)*x_c(n)]$ |
| | | $\psi_M\{e(n)\}=\begin{cases} e(n) & 0\leq\lvert e(n)\rvert\leq\xi \\ \xi\,\mathrm{sign}[e(n)] & \xi<\lvert e(n)\rvert\leq\Delta_1 \\ \left[(\lvert e(n)\rvert-\Delta_2)\frac{\xi}{\Delta_1-\Delta_2}\right] & \Delta_1<\lvert e(n)\rvert\leq\Delta_2 \\ 0 & \Delta_2<\lvert e(n)\rvert\end{cases}$ |

Figure 2:
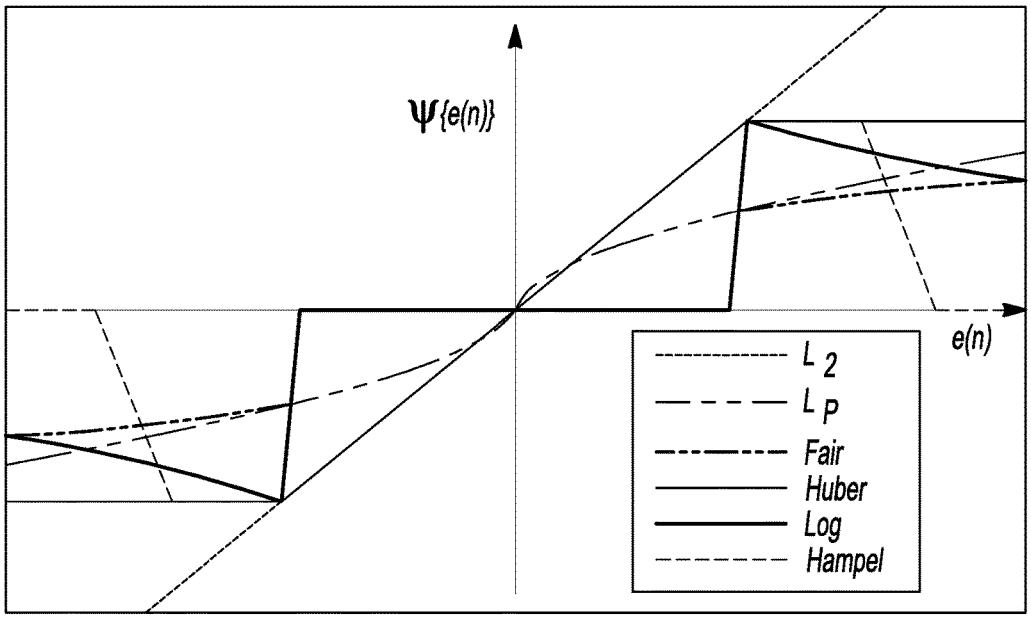
FIG. 2 is a plot of score functions for various M-estimators.

FIG. 2 describes the score functions for all these M-estimators. It can be seen that there is no restriction on large impulsive samples when the second order space $L_2$ is taken as the criterion. This is why the conventional FXLMS algorithm is sensitive to the instantaneous increase of the power in the error signal. In contrast, the M-estimator functions put constraints on the outlier of the error function. It seems that both the logarithmic transformation based algorithm (FX Log LMS) and Hampel M-estimator based algorithm (FXLMM) impose "harder" limits, and the score functions descend to zero more sharply when the impulses with large amplitudes occur. These two algorithms can be effective for large impulsive noises. However, the logarithmic and three parts threshold calculation increase the complexity of the algorithm. On the other hand, both the $L_p$ space and Fair M-estimator do not offer hard bounds when large samples occur. Moreover, the FXLMP algorithm gives smooth restriction of the scoring function. And, the score function of the Fair algorithm offers better constraint than the FXLMP algorithm. It seems that the Fair algorithm will show better performance for the more highly impulsive noises. It is also noted that the Huber M-estimator offers two part thresholds in which the impulsive samples are replaced by the upper and lower limit threshold values. The score function of the Huber function does not descend to zero like the Log space and Hampel's three parts function, but it provides better restriction than the $L_p$ space and Fair M-estimator.

The proposed family of robust M-estimator based algorithms is able to enhance the robustness of conventional FXLMS algorithm for impulsive samples. To deal with other inherent limitations of the FXLMS algorithm such as high computational burden and low convergence speed for colored noise, a subband adaptive filtering approach is adopted. Hence, the proposed subband-based modified FXLMM algorithm with threshold tends to be a more promising approach for designing a robust broadband ANC system.

Subband Processing

A procedure for a delayless subband adaptive filtering technique with modified FXLMM algorithm may include the following:

1) A full-band adaptive filter for processing the input reference signal
2) Decomposition of reference and error signals into subbands
3) Decimation in subbands
4) Filter weight update in each subband
5) A weight stacking method to transform subband weights into a fullband The first step in implementing a subband algorithm is to design analysis filter banks for decomposing the input signal. There are various approaches to designing these analysis filter banks to decompose the reference and error signals into a set of subband signals. Here, the DFT filter banks are adopted. This approach is realized by designing a low-pass prototype filter first, and then other analysis filter banks are generated through complex modulation. The prototype filter $H_0$ can be designed using a MATLAB embedded function:

$$H_0=fir1(L_p-1,1/M) \tag{6}$$

where $L_p$ is the order of the prototype filter and M is the number of subband filter banks (note M is an even number). Then, other M−1 filter banks $[H_1, H_2, \ldots, H_{M-1}]$ can be obtained by complex modulation. The modulation process in the time-domain is realized by $$h_m(i)=h_0(i)e^{j(i2\pi m/M)} \tag{7}$$

where $h_m$ is the impulse response of the m-th filter bank $H_m$, m=0, 1, . . . , M−1, and i is the i-th coefficient of $h_m$, i=0, 1, . . . , $L_p$. It is noted that the coefficients of $h_m(i)$ and $h_{M-m}(i)$ are complex conjugates for m=1, 2, . . . , M/2−1. Hence for real signals, only the first M/2+1 subbands need to be processed. In addition, the center frequencies of these filter banks are uniformly distributed with constant bandwidth. As such, the subband algorithm used here is called a uniform subband. This is primarily due to the modulation design process. Through the decomposition of the fullband signal into subbands, each subband signal contains only 1/M of the original frequency band. Thus, the subband signal can be maximally decimated by the factor M without losing any information. The decimation factor is defined as D. The decomposition process of reference and error signals can be illustrated by:

$$x_m(\kappa)=\Sigma_{i=0}^{L_p}h_m(i)x_c(\kappa D-i) \tag{8}$$

$$e_m(\kappa)=\Sigma_{i=0}^{L_p}h_m(i)e_c(\kappa D-i) \tag{9}$$

where $x_m(\kappa)$ and $e_m(\kappa)$ are the reference signal and error signal respectively in the m-th subband, m=0, 1, . . . , M−1, the error signal after M-estimator is defined as $e_c=\psi\{(n)\}$, and κ is the block index, iκ=(n−1)/D. To further reduce the computational complexity, the estimated secondary path transfer functions $\hat{S}(z)$ can also be implemented in subbands. As shown in FIG. 1, the fullband $\hat{S}(z)$ is decomposed into a set of subband functions, $\hat{S}_0(z), \hat{S}_1(z), \ldots, \hat{S}_{M-1}(z)$. These subband transfer functions can be estimated by using offline or online system identification approaches in which the broadband noise generator can be decomposed into corresponding subbands. Each impulse response $\hat{s}_m$ of the subband secondary path $\hat{S}_m(z)$ contains I/D coefficients, here I is the order of the fullband secondary path FIR filter. Hence, the filtered reference signal in each subband is $$x'_m(\kappa)=x_m(\kappa)*\hat{s}_m \tag{10}$$

where * denotes the convolution process.

Then, the filter weights update equation in the m-th subband is $$w_m(\kappa+1)=w_m(\kappa)+\mu_m\overline{x'_m(\kappa)}e_m(\kappa) \tag{11}$$

which is a complex valued update process. $\mu_m$ is the convergence step size at each subband, $w_m(\kappa)=[w_{m,0}(\kappa), w_{m,1}(\kappa), \ldots, w_{m,N/D}(\kappa)]^T$ is the subband filter weight vector with length N/D, $x'_m(\kappa)=[x'_m(\kappa), x'_m(\kappa-1), \ldots, x'_m(\kappa-N/D)]^T$ is the reference signal vector of the m-th subband filter, and $\overline{[\bullet]}$ denotes the complex conjugate. The step size $\mu_m$ can be normalized with respect to the inverse filtered reference signal power in the corresponding subband:

$$\mu_m=\frac{\mu}{x'^T_m(\kappa)x'_m(\kappa)+\epsilon} \tag{12}$$

where μ is the normalized step size, and ϵ is a small constant value to avoid infinite step size. Then, the filtered reference signal vector $x'_m(\kappa)$ and $w_m$ can be stacked up into a long vector in each subband.

The next step is to transform a set of subband filter weights into an equivalent fullband one. There are several weight transformation techniques proposed in public literature (e.g., FFT-stacking, FFT-2 stacking, DFT-FIR weight transform, and linear weight transform). Here, the FFT-stacking method is adopted. The subband filter weights $w_m$ are transformed into the frequency domain by N/D-point FFT:

$$W_m=\left[W_m(0), W_m(1), \ldots, W_m\left(\frac{N}{D}-1\right)\right]^T=FFT\{w_m\} \tag{13}$$

Then those frequency-domain coefficients $w_m$ in each subband filter m=0, 2, . . . , M−1 are properly stacked to formulate an N elements array:

$$W=[W(0),W(1), \ldots ,W(N-1)]^T \tag{14}$$

where W is the frequency-domain coefficient of the fullband filter. The FFT-stacking rule is 1) $W(l)=W_{\lfloor lM/N\rfloor}((l)_{2N/M})$, for $l\in\left[0, \frac{N}{2}-1\right]$ 2) $W(l)=0$, for $l=N/2$ 3) $W(l)=\overline{W(N-l)}$, for $l\in\left[\frac{N}{2}+1, N-1\right]$ where W(l) is the l-th frequency-domain coefficient of the fullband filter, ⌊lM/N⌋ denotes rounding lM/N to the nearest integer, and $(l)_{2N/M}$ stands for l modulus 2N/M. After stacking the fullband weights from each subband following the above stacking rule, the time-domain coefficient of the fullband adaptive filter W(z) is obtained by taking the IFFT of W:

$$w(n)=\mathrm{IFFT}\{W\} \tag{15}$$

where $w(n)=[w_0, w_1, \ldots, w_{N-1}]^T$. Then the output signal from the fullband adaptive filer can be generated by Eqn. (1a).

Threshold Parameters Estimation

Online Method

For the Fair M-estimator function, the threshold parameter c can be determined by offline or online estimation approaches. As discussed by others in the field, the parameter c can be computed as 1, 1.5, 2 and 3 times the average absolute value of the error signal. It has been found that the control performance is not sensitive to the value of c, and it has been suggested that the online identification approach employ the following:

$$c(n) = \frac{1}{M}\sum_{i=0}^{M-1}|e(n-i)| \tag{16}$$

For the Hampel three-part M-estimator function, the three threshold parameters ξ, $\Delta_1$ and $\Delta_2$ can be estimated by an on-line method proposed in the available literature through the variance estimation of the "impulse-free" samples. The robust estimation formula of the variance $\hat{\sigma}_e(n)$ is given by $$\hat{u}(n)=\lambda\hat{u}(n-1)+C_1(1-\lambda)e(n) \tag{17a}$$

$$\hat{\sigma}_e^2(n) = \lambda\hat{\sigma}_e^2(n-1) + C_1(1-\lambda)med\{A'_e(n)\} \tag{17b}$$

$$\begin{cases} \xi = 1.960\hat{\sigma}_e(n) \\ \Delta_1 = 2.240\hat{\sigma}_e(n) \\ \Delta_2 = 2.576\hat{\sigma}_e(n) \end{cases} \tag{17c}$$

where the impulse's adverse effect on the variance estimation can be guaranteed by computing the median of the term $A'_e(n)=\{[e(n)-\hat{u}(n)]^2, [e(n-1)-\hat{u}(n-1)]^2, \ldots, [e(n-N_w+1)-\hat{u}(n-N_w+1)]^2\}$. λ is the forgetting factor and satisfies $0<\lambda<1$. And, $N_w$ is the window length. The median can be found using a sorting algorithm from a sequence of data.

Figure 3:
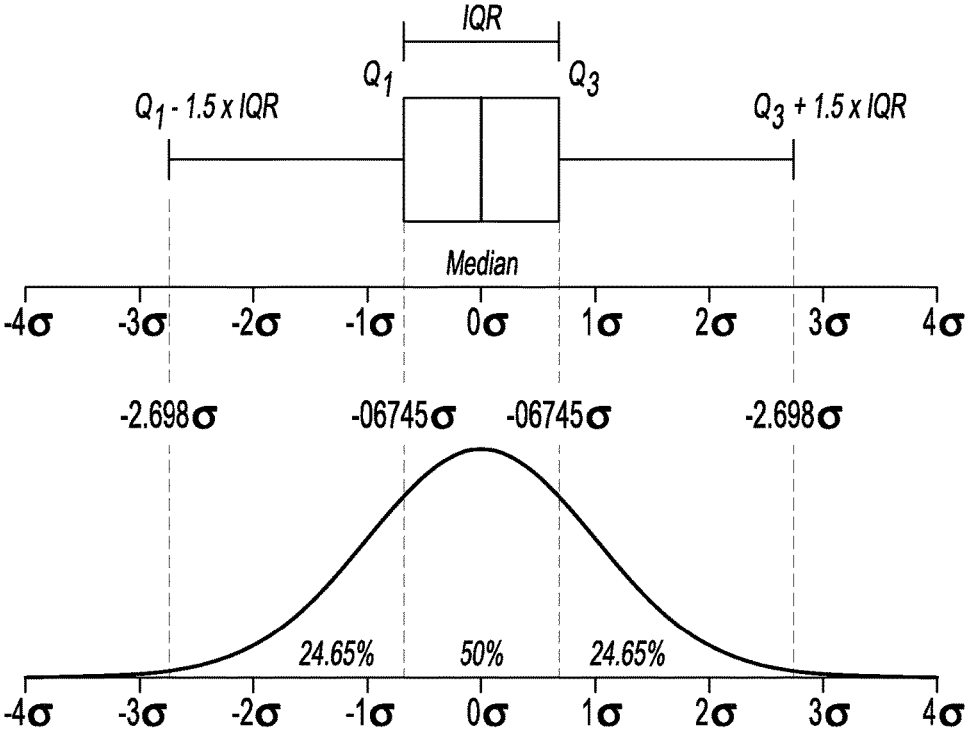
FIG. 3 is a box-plot and probability distribution function (PDF) of a Gaussian dataset.
Figure 4:
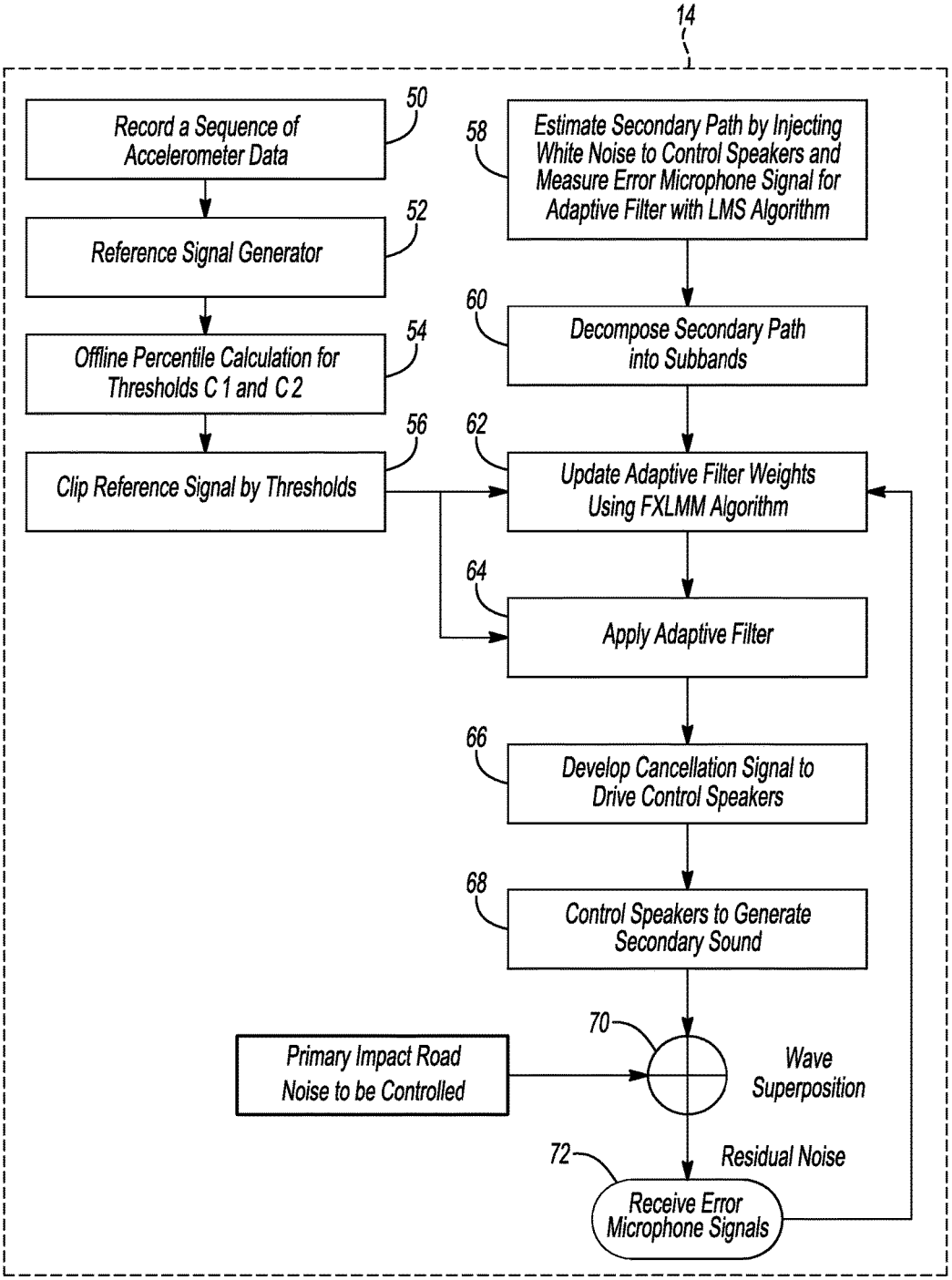
FIG. 4 is a flowchart of an active noise control (ANC) system with threshold for impact road noise.

For the Huber M-estimator that offers a two part threshold, the threshold parameters can be determined through online percentile estimation. Here, the box-plot (BP) algorithm shown in FIG. 3 is applied, which works as follows for a given vector of data:

1) Find the first and third quartiles ($Q_1$ and $Q_3$), here $Q_1$ (25th percentile) and $Q_3$ (75th percentile) represent data that are bigger than 25% and 75% of the whole vector of data, respectively 2) Define the interquartile range as $IQR=Q_3-Q_1$ 3) Set the threshold bounds: $c_1=Q_1$ 1.5×IQR, $c_2=Q_3+1.5\times IQR$ 4) The BP algorithm is applied to a sliding window of $N_w$ data that can be sorted by using a Bubble sorting algorithm. For each new data at sample time n:

i) If either $x(n)\leq c_1$ or $x(n)\geq c_2$, the sliding window of data is not updated ii) Else, delete the oldest datum from the sliding window and insert the new one in the correct position, then compute the bounds using the BP algorithm Offline Method The threshold parameters can be also determined through offline identification by calculating the percentiles. Hence, it requires a prior measurement of the reference and error signals. For example in road noise applications, a systematical measurement is needed to statistically determine the approximate thresholds under different road conditions. A flowchart diagram for an ANC system with threshold is shown in FIG. 4. At operation 50, a sequence of accelerometer data is recorded. At operation 52, the reference signal generator is applied to the accelerometer data. At operation 54, an offline percentile calculation for thresholds $c_1$ and $c_2$ is performed. And at operation 56, the reference signal is clipped by the thresholds. At operation 58, the secondary path is estimated in the block 40 of FIG. 1 by injecting white noise through the noise generator block 36 to the speaker 48 and measuring the response via the microphone 46. At operation 60, the estimated secondary path is decomposed into subbands. At operation 62, the adaptive filter weights are updated using the FXLMM algorithm. At operation 64, the adaptive filter is applied. As apparent from FIG. 4, operations 62, 64 use the clipped reference signal as input. At operation 66, the cancellation signal is developed to drive control of the speakers. At operation 68, the speakers are controlled to generate the secondary sound. At operation 70, wave superposition is performed on the primary impact road noise to be controlled and the secondary sound. At operation 72, error microphone signals are received. The algorithm then returns to operation 62. Similarly, the online threshold identification can be formulated by replacing the threshold block of the flowchart.

Numerical Simulation

Figure 5:
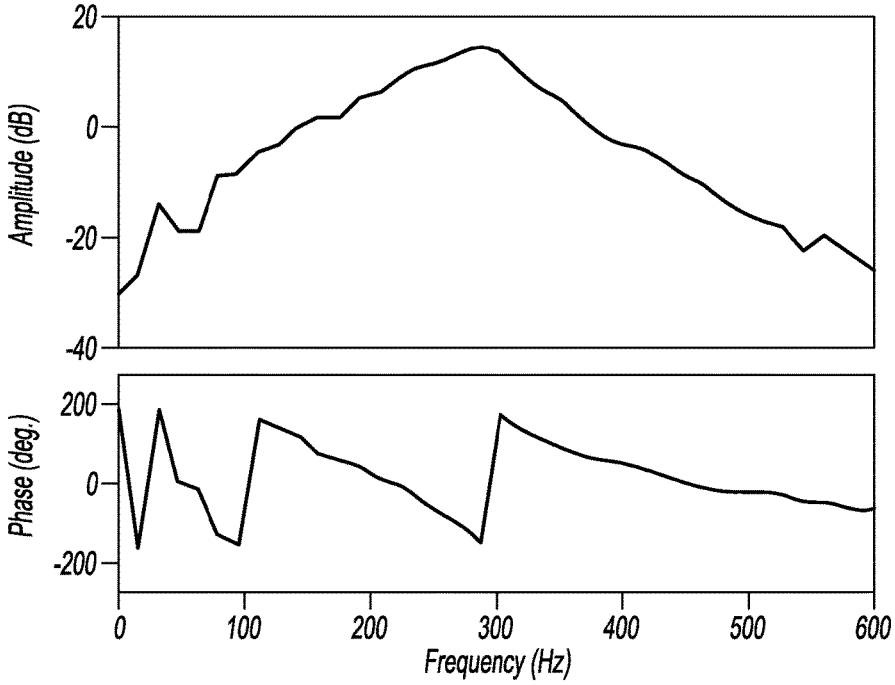
FIG. 5 is a plot of secondary path magnitude and phase response.

The interior acoustic responses due to tire/road interaction with various road unevenness profiles and performance of the control system have been simulated. In these simulations, different interior acoustic responses due to road profile with numerous impact bumps were considered, which were measured from experimental road tests. The ANC system is designed to attenuate the normal and impact road noise around the driver's and passenger's head positions. The error microphones are placed at the ceiling of the vehicle cabin over the heads. The estimated transfer function of the secondary path from loudspeaker to the sound pressure at the error microphone was measured experimentally using an off-line system identification approach. The frequency response function of the secondary path model used in this simulation is as shown in FIG. 5. The secondary path model was formulated as a finite impulse response (FIR) filter, and the same secondary path model was used both in the reference signal path and after the controller output. In case one, the measured road noise (from a normal road surface without any bumps or potholes transitions to bumpy roads with three impacts and then to a normal road surface) is used for simulation. In case two, a combined road surface consisting of ten repetitive impact events followed by normal road noise is taken for the simulation to evaluate the performance of the ANC system using different control algorithms.

Figure 6:
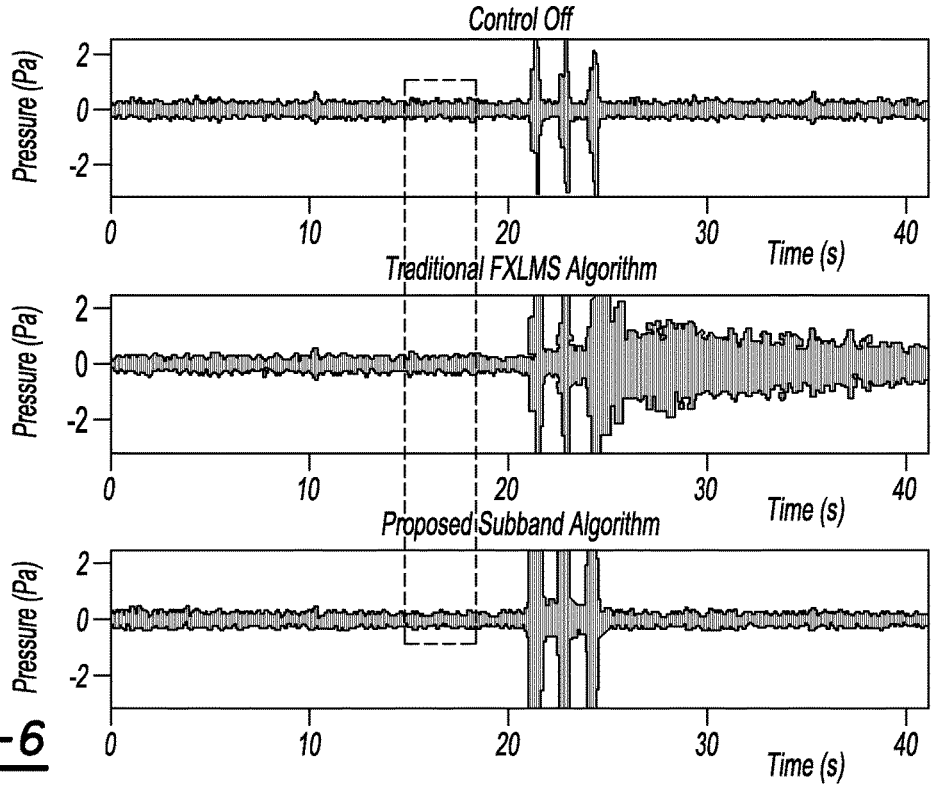
FIG. 6 is a plot of time history of the controlled result for normal road noise with three impact events.

FIG. 6 shows the time-domain simulation result for case one with normal road noise contaminated with three impact events. Here, the threshold parameters for the proposed subband FXLMM algorithm were determined through offline percentile calculation. The upper and lower limits in the threshold block are chosen as the 99.9 and 0.1 percentile of the whole data. The convergence step size for the traditional FXLMS algorithm is $\mu$=5e−4 and that for the subband algorithm is $\mu$=1e−3. It is noted from FIG. 6 that the FXLMS algorithm becomes unstable upon occurrence of the impact events, and it takes a long time for the system to converge back for the normal road noise after the impacts. While the proposed subband algorithm has enhanced robustness at the impact events. This is primarily due to the threshold incorporated in the adaptive filter weight update process. The traditional FXLMS algorithm does not have this robustness unless reducing the convergence step size in which there will be barely any reductions at the normal road noise (lower power requires larger step size).

Figure 7:
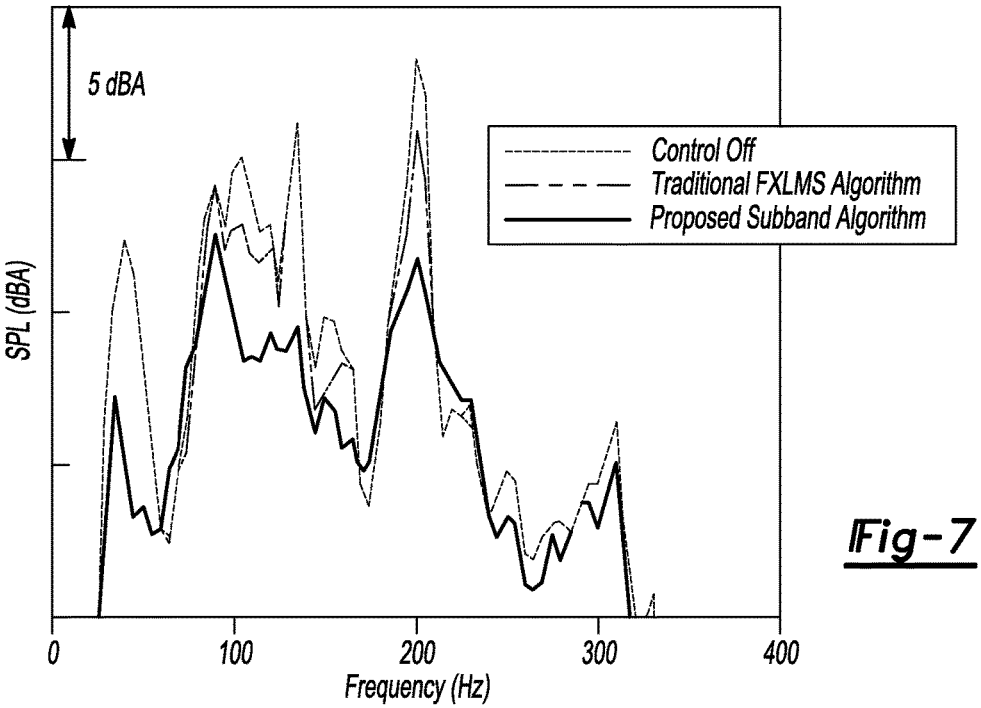
FIG. 7 is a plot of frequency spectrum of the normal road noise before and after control in the dashed box of FIG. 6.

More clear comparison is shown in the spectrum result of FIG. 7. Here, it is the frequency-domain result of the controlled response in the dashed box of FIG. 6. The proposed subband algorithm yields more reductions in the broader frequency range. This is a unique advantage of the subband processing for the colored noise since the eigenvalue spread of the filtered reference signal can be equalized. The equalization of eigenvalues can yield a better step size for each individual frequency. However, the traditional FXLMS algorithm tends to target on the noise spectrum with highest power since the step size is optimal at that frequency only.

Figure 8:
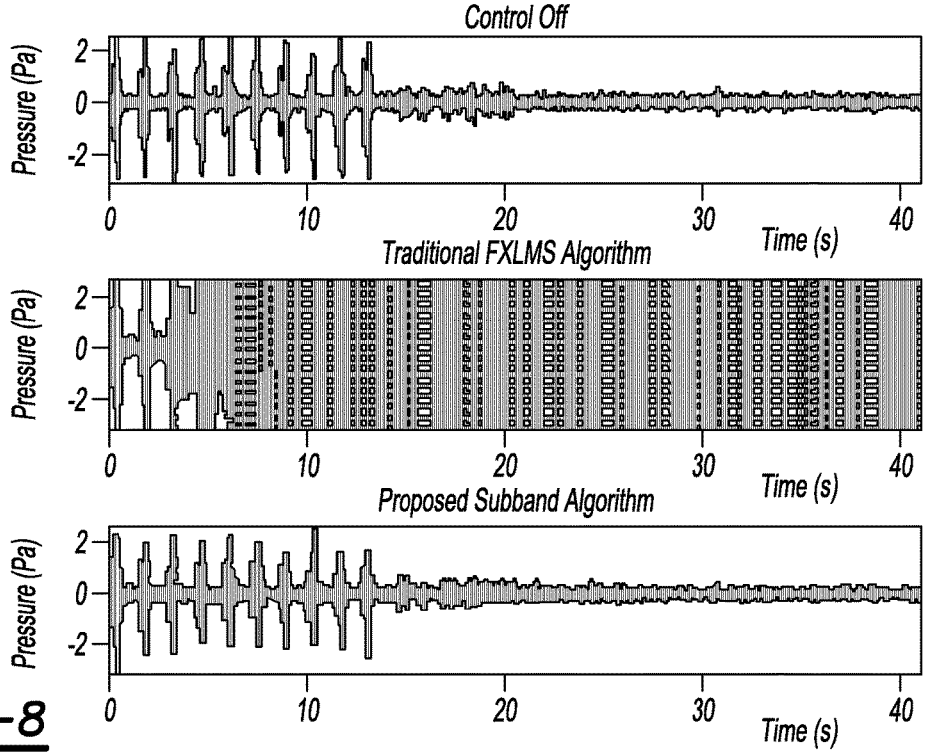
FIG. 8 is a plot of time history of the controlled result for ten impact events and normal road noise.
Figure 9:
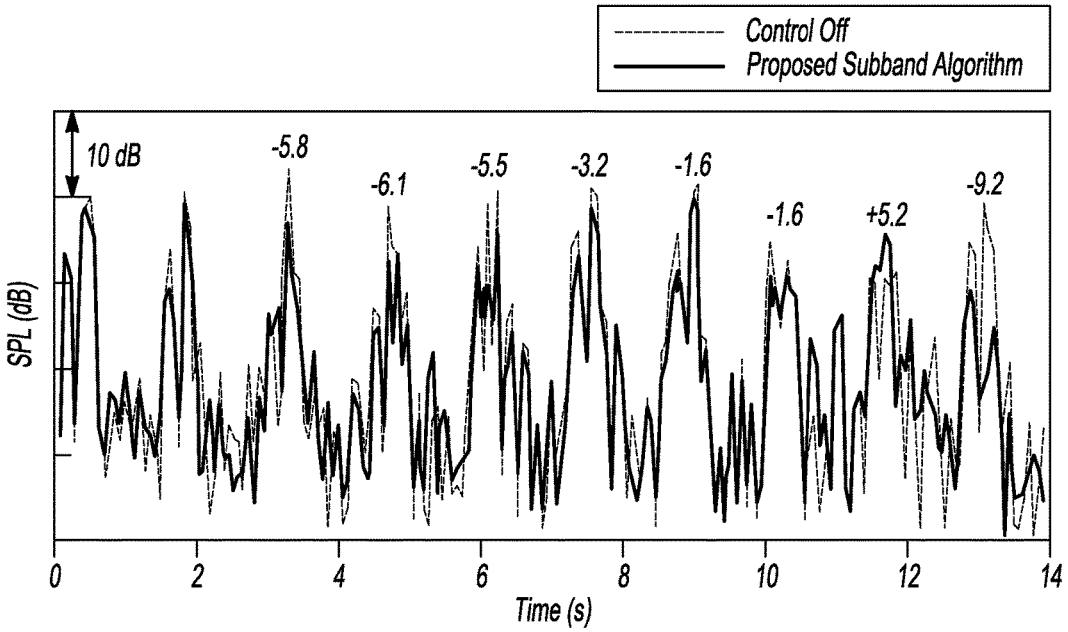
FIG. 9 is a plot of sound pressure level of the ten impact road noises before and after control.
Figure 10:
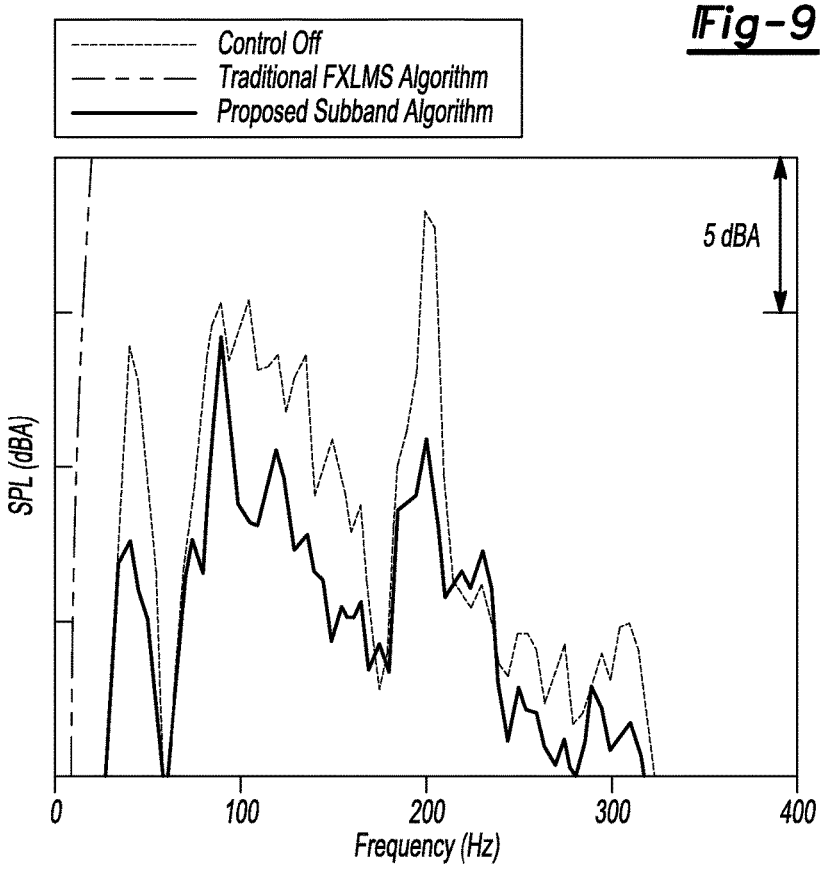
FIG. 10 is a plot of spectra of the normal road noise before and after control in the last 2 seconds of FIG. 8.

FIGS. 8 through 10 depict further simulation results for case two in which the combined road noise with ten impact events followed by normal road noise is considered. The parameter values for each algorithm are the same as that used in case one. In FIG. 8, it is apparent that the traditional FXLMS algorithm shows severe instability after the first two impact events. On the other hand, the proposed subband algorithm starts to converge after several consecutive impact events. Also, it shows more stability after the impacts and converges fast for the normal road noise. FIG. 9 is the sound pressure level for the subband algorithm at the impact road noise events before and after control. There is a several dB reduction after the first two impacts unless certain amplification is observed for the impact event around 12 seconds. The frequency-domain control result for the normal road noise in the last 2 seconds is shown in FIG. 10. Similarly, the subband algorithm can generate an overall 5 dBA noise reduction in the frequency range from 50-320 Hz.

CONCLUSIONS

ANC systems configured with enhanced subband FXLMM (filtered-x least mean M-estimator) algorithms with thresholds on reference and error signal paths for road noise with impacts inside the vehicle cabin were discussed above. These systems may provide more robust and balanced performance for colored road noise over a broader frequency range. The subband processing equalizes the eigenvalue spread of the filtered reference signal, which overcomes the inherent limitations of the traditional FXLMS algorithm. Hence, fast convergence can be obtained and optimal performance achieved over a broader frequency range. Furthermore, the modified FXLMM algorithm with thresholds for the impulsive samples in the reference and error signals tend to enhance the robustness of the adaptive filter weight update process that might be easily disturbed by peaky data.

The processes, methods, or algorithms disclosed herein may be deliverable to or implemented by a processing device, controller, or computer, which may include any existing programmable electronic control unit or dedicated electronic control unit. Similarly, the processes, methods, or algorithms may be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms may also be implemented in a software executable object. Alternatively, the processes, methods, or algorithms may be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A vehicle system comprising:

an active noise control (ANC) system including a processor programmed to implement an adaptive subband filtered reference control algorithm that applies thresholds to reference and error feedback signal paths such that, responsive to broadband non-Gaussian impulsive reference signals indicative of road noise and detected via sensors, weight coefficients defining an adaptive filter of the control algorithm converge and permit the ANC system to partially cancel the road noise via a speaker.

2. The vehicle system of claim 1, wherein values of the thresholds are based on a variance of magnitudes of the impulsive reference signals.

3. The vehicle system of claim 2, wherein the values increase as the variance increases.

4. The vehicle system of claim 1, wherein values of the thresholds are based on percentile characteristics of the impulsive reference signals.

5. The vehicle system of claim 1, wherein the adaptive subband filtered reference control algorithm is delayless.

6. The vehicle system of claim 1, wherein the adaptive subband filtered reference control algorithm is a filtered-x least mean square (FXLMS) adaptive subband filtered reference control algorithm or a filtered-x least mean M-estimator (FXLMM) adaptive subband filtered reference control algorithm.

7. The vehicle system of claim 1, wherein the adaptive subband filtered reference control algorithm includes a discrete Fourier transform (DFT) filter bank.

8. The vehicle system of claim 7, wherein the DFT filter bank is a uniform bandwidth DFT filter bank or a variable bandwidth DFT filter bank.

9. A method comprising:

applying, via a processor-implemented adaptive subband filtered reference control algorithm, a first threshold to a reference signal path and a second threshold to an error feedback signal path such that, responsive to a series of broadband non-Gaussian impulsive reference signals indicative of road noise and detected by sensors, weight coefficients defining an adaptive filter of the control algorithm converge to permit partial cancellation of the road noise via output of a speaker.

10. The method of claim 9, wherein values of the thresholds are based on a variance of magnitudes of the impulsive reference signals.

11. The method of claim 10, wherein the values increase as the variance increases.

12. The method of claim 9, wherein values of the thresholds are based on percentile characteristics of the impulsive reference signals.

13. The method of claim 9, wherein the adaptive subband filtered reference control algorithm is delayless.

14. The method of claim 9, wherein the adaptive subband filtered reference control algorithm is a filtered-x least mean square (FXLMS) adaptive subband filtered reference control algorithm or a filtered-x least mean M-estimator (FXLMM) adaptive subband filtered reference control algorithm.

15. The method of claim 9, wherein the adaptive subband filtered reference control algorithm includes a discrete Fourier transform (DFT) filter bank.

16. The method of claim 15, wherein the DFT filter bank is a uniform bandwidth DFT filter bank or a variable bandwidth DFT filter bank.

17. An active noise control (ANC) system comprising:

accelerometers, a microphone, and a speaker; and one or more processors programmed to implement an adaptive subband filtered reference control algorithm that applies thresholds to reference and error feedback signal paths such that, responsive to a series of broadband non-Gaussian impulsive reference signals detected via the accelerometers or microphone and indicative of road noise in a vehicle having an audible frequency range of 20 Hz to 20 kHz, weight coefficients defining an adaptive filter of the control algorithm converge and permit the ANC system to partially cancel the road noise via output of the speaker.

18. The system of claim 17, wherein the adaptive subband filtered reference control algorithm is delayless.

19. The system of claim 17, wherein the adaptive subband filtered reference control algorithm is a filtered-x least mean square (FXLMS) adaptive subband filtered reference control algorithm or a filtered-x least mean M-estimator (FXLMM) adaptive subband filtered reference control algorithm.

20. The system of claim 17, wherein the adaptive subband filtered reference control algorithm includes a discrete Fourier transform (DFT) filter bank.

* * * * *